US006623043B1

(12) United States Patent
Pollack

(10) Patent No.: US 6,623,043 B1
(45) Date of Patent: Sep. 23, 2003

(54) FLUID TRANSFER BOOM WITH COAXIAL FLUID DUCTS

(75) Inventor: Jack Pollack, Marly (CH)

(73) Assignee: Single Buoy Moorings Inc., Marly (CH)

( * ) Notice: Subject to any disclaimer, the term of this patent is extended or adjusted under 35 U.S.C. 154(b) by 0 days.

(21) Appl. No.: 09/647,535

(22) PCT Filed: Mar. 4, 1999

(86) PCT No.: PCT/EP99/01405

§ 371 (c)(1),
(2), (4) Date: Oct. 2, 2000

(87) PCT Pub. No.: WO99/50173

PCT Pub. Date: Oct. 7, 1999

(30) Foreign Application Priority Data

Apr. 1, 1998 (EP) ..... 98201027

(51) Int. Cl.[7] ..... B65B 3/04

(52) U.S. Cl. ..... 285/121.2; 285/147.1; 285/299; 285/145.5; 285/904

(58) Field of Search ..... 285/147.1, 275, 285/281, 299, 121.1, 121.2, 121.3, 121.6, 121.5, 145.2, 145.5, 224, 225, 226, 227, 904

(56) References Cited

U.S. PATENT DOCUMENTS

| | | | | |
|---|---|---|---|---|
| 803,648 | A | * 11/1905 | Williams | 285/121.1 |
| 2,450,895 | A | * 10/1948 | Keim | 285/121.3 |
| 2,834,465 | A | * 5/1958 | McMicael | 285/121.6 |
| 3,032,082 | A | * 5/1962 | Vilain | 137/615 |
| 3,133,754 | A | * 5/1964 | Peters | 285/145.5 |
| 3,154,118 | A | * 10/1964 | Silveston | 137/615 |
| 3,199,898 | A | * 8/1965 | Faccou | 285/121.6 |

FOREIGN PATENT DOCUMENTS

| | | |
|---|---|---|
| FR | 2113851 | 6/1972 |
| FR | 2234221 | 1/1975 |
| GB | 1060953 | 3/1967 |

OTHER PUBLICATIONS

XP–002075425, Thomas EHRET, "*The Cryogenic Loading Arm*", Gas Supplies and Technologies, vol. 50, No. 544, 1982, pp. 47–54.

(List continued on next page.)

*Primary Examiner*—David Bochna
(74) *Attorney, Agent, or Firm*—Young & Thompson

(57) ABSTRACT

The invention relates to a storage structure having a fluid transfer boom for transfer of cryogenic liquids such as liquified natural gas (LNG) from a first storage structure to a vessel. The boom has two arms which are rotatably connected at their first ends via a swivel joint. In one embodiment a liquified natural gas duct is supported within the first and second arms which form a gas tight housing around the liquified natural gas duct. The transfer boom according to the present invention provides a redundant containment system wherein the LNG duct is supported by the structurally strong and self-supporting transfer boom which confines the natural gas in case of a leak in the inner LNG duct. In a further embodiment the transfer boom comprises seven swivel joints in total such that rotation in all directions is possible when the vessel is moored to the storage structure and has to cope with relative motions of roll, pitch, yaw, heave, sway and surge. The first arm may be suspended from the storage structure in a generally vertical direction, the second arm extending between the first end of the first arm and the vessel in a generally horizontal direction. Hereby a reliable, self-supporting construction can be achieved without the use of counterweights or tensioning cables for the vertical arm. Preferably the swivel joints are each of a substantially similar construction such that the costs of manufacture can be reduced. Another embodiment provides for the inner LNG duct being provided with leak containment means and with deformable wall parts for allowing thermal expansion.

8 Claims, 6 Drawing Sheets

Figure 1:
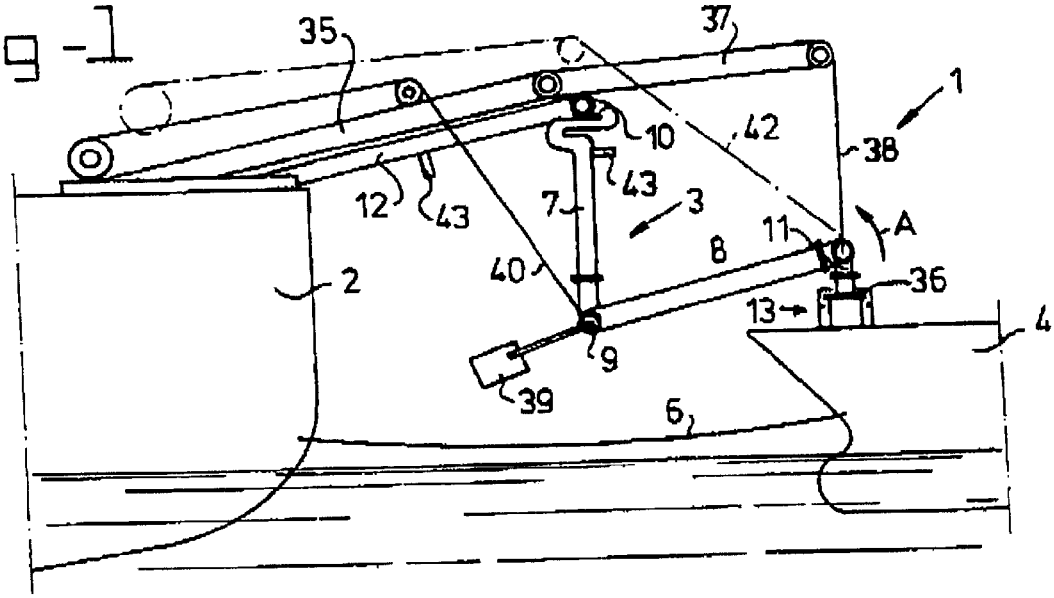

U.S. PATENT DOCUMENTS 3,372,715 A * 3/1968 Ashton ..... 137/615
3,414,918 A * 12/1968 Petrie et al. ..... 137/615
3,542,068 A * 11/1970 Prescott ..... 137/615
3,596,674 A 8/1971 Yokohama et al.
3,606,394 A * 9/1971 Maurer et al. ..... 285/121.3
3,675,680 A 7/1972 Frohlich et al.
4,262,712 A * 4/1981 Young ..... 137/615
4,388,948 A * 6/1983 Carminati et al. ..... 137/615
4,393,906 A * 7/1983 Gill ..... 137/615
4,687,024 A * 8/1987 McMath ..... 137/615
5,458,375 A * 10/1995 Anspach et al. ..... 285/121.2 X
5,758,687 A * 6/1998 Funicello ..... 137/615

* cited by examiner

FLUID TRANSFER BOOM WITH COAXIAL FLUID DUCTS

The invention relates to a loading structure comprising a fluid transfer boom for transfer of cryogenic liquids from a first storage structure to a vessel, the boom having a first arm and a second arm which are mutually connected at a first end via a swivel joint. The invention in particular relates to a loading structure for liquified natural gas.

A fluid transfer boom for use in such a loading structure is described in U.S. Pat. No. 4,022,498. In this patent a marine loading arm for transferring hydrocarbons from an on shore loading structure to a tanker is disclosed. On the loading structure a first arm of the boom is connected to a vertical supporting pipe via two swivel joints. The first arm is maintained in a generally vertical position by means of a counter weight and tensioning cables. At the end of the first arm a second arm is connected via a swivel joint such that the centre lines of both arms can define a plane in which the arms can be moved and the angle between the arms can be varied. The end part of the second arm which is to be coupled to a tanker comprises three swivel joints for rotation around three perpendicular axes.

The known transfer boom that is described in the above US-patent has as a disadvantage that relatively large and complex counter weights and tensioning cables are necessary to maintain the arms in their proper position. These may be subject to failure and intensive maintenance when used in the often harsh offshore environment. Furthermore, upon use of the known transfer boom for transfer of liquified natural gas (LNG), the LNG could escape from the transfer boom to the atmosphere, creating a potentially hazardous flammable and/or explosive environment.

It is therefore an object of the present invention to provide a loading structure which is particularly suitable for transfer of LNG, and which can be operated in a reliable and safe manner.

It is another object of the present invention to provide a loading structure having a fluid transfer boom suitable for offshore use, which is fully self-aligning when in use and which can be produced and maintained at low costs.

Hereto the loading structure according to the present invention is characterised in that a liquid natural gas duct is supported within the first and second arms, which form a gas tight housing around the liquified natural gas duct.

The transfer boom according to the present invention provides a redundant containment system wherein the LNG duct is supported by the structurally strong and self-supporting transfer boom which confines the natural gas in case of a leak in the inner LNG duct. The arms of the transfer boom shield the sensitive low temperature LNG fluid paths and swivel joints from the contact with the outer environment. Hereby the chances of mechanical and/or chemical damage to the LNG duct and its swivel joint, for instance by relative movements of the storage structure and a shuttle tanker or from the sea water, are reduced. The transfer boom according to the present invention can be used for loading LNG to and from an on shore storage structure or can be used offshore on a floating storage structure.

The outer walls of the arms may define a continuous fluid path between the second ends of the arms, such that gas may be drawn out and any LNG vapour may be recovered, re-liquified and transported through the LNG duct.

In one embodiment according to the present invention, the LNG duct is provided with an internal swivel joint at a position that corresponds with the swivel joint of the outer arms. The LNG duct is near its internal swivel joint connected to the internal wall of the outer arms. For instance at the position of the swivel joint, the LNG duct may be provided with deformable wall parts. Thereby the LNG ducts can follow the motions of the outer supporting arms while the deformable wall parts, which may comprise a bellow or a slip joint or a section of the duct made of flexible piping, allow for thermal expansion and contraction of the LNG ducts. The deformable wall parts function as alignment means to maintain the internal swivel joint of the LNG duct in a concentric position with respect to the swivel joint of the outer supporting arms.

The LNG duct may be placed in a concentric configuration with a vapour return duct. In one embodiment the vapour return duct comprises a non-concentric duct within each outer supporting arm, wherein the internal swivel comprises an outer toroidal LNG vapour chamber around the LNG duct. The toroidal LNG vapour chamber of the internal swivel has an inlet connected to an upstream vapour duct section and an outlet connected to a downstream vapour duct section. According to this construction, the vapour return duct—which has a higher temperature than the LNG duct—can be properly insulated from the colder LNG duct and from the hotter side walls of the outer supporting arms. Furthermore, upon leakage of the swivel joint of the LNG duct, the LNG will be confined in the surrounding toroidal swivel chamber of the vapour return duct.

The space within the outer supporting arms surrounding the LNG duct and the vapour return duct, may be filled with a non-flammable gas, such as an inert gas. In this way, the chances of the LNG vapour forming an explosive mixture with the outer atmosphere upon leakage from the LNG duct is reduced. For further containment of the LNG, a pressurised gas at a pressure above the pressure in the LNG duct or in the vapour return duct may be used, such as pressurised air or a pressurised inert gas.

For monitoring the integrity of the LNG duct and swivel, the supporting arms may be provided with a gas sampling opening in the wall thereof for sampling and analysing the gas for traces of hydrocarbons.

An embodiment of loading structure which is particularly suitable for LNG, but which may also be used for the transfer of other substances such as crude oil or oil products, is characterised in that the arms comprise at least seven swivel joints in total, each arm being rotatable around three perpendicular axes, the first arm being suspended from the storage structure in a generally vertical direction, wherein the second arm can extend between the end of the first arm and the vessel in a generally horizontal direction. The transfer boom according to the present invention provides a relatively simple self-supporting construction which can move in all directions due to the seven swivel joints. The transfer boom is suitable for offshore offloading operations between a floating storage structure and a tanker such as between a weathervaning storage vessel and a shuttle tanker, and can be used under sea conditions when wave and current induced motions of the storage structure and the vessel cause relative pitch, roll and yaw, heave surge and sway. Because the first arm is suspended from the storage structure and carries the second arm, the transfer boom is self supporting and can be easily manoeuvred during coupling, decoupling and retracting it to a parking position. By attaching a counterweight to the first end of the arms, the loading structure of the present invention forms an offshore mooring boom that exerts a restoring force on the shuttle tanker and which allowes for a quick disconnection in emergency situations, where in the horizontal arm will swing back to a substantially upright position which is out of the way of the shuttle tanker.

In a preferred embodiment, the swivel joints are of substantially similar construction. In this way construction and maintenance costs of the transfer boom can be reduced.

In a further embodiment of the loading structure according to the present invention, the first am comprises at its first and second ends substantially similar, generally unshaped piping structures comprising, relative the centre line of the arm, a 90° bend and connected thereto a 180° bend.

By using substantially similar u-shaped piping structures, the swivel joints of the first arm can be placed in vertical alignment below the suspension point of the arm, so that minimal bending moments are exerted on the swivel joints.

In a further embodiment each arm comprises a substantially similar mid-section comprising on one end a fixed flange and on the other end a substantially similar swivel joint. Upon breakdown of one of the arms, it can easily be replaced by a spare part that may be used for both first and second arms.

Figure 2:
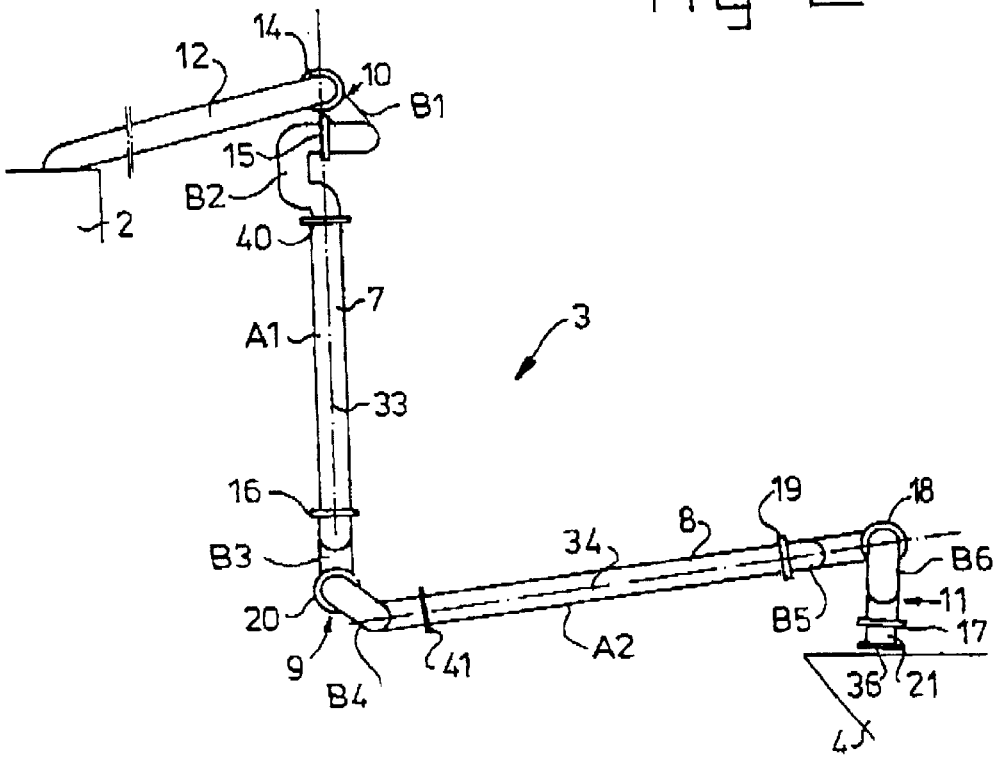
Figure 3A:
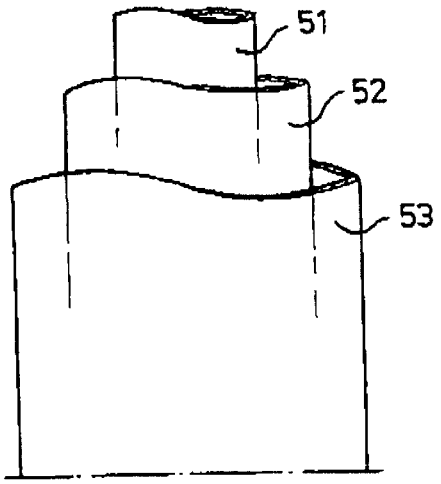
Figure 3B:
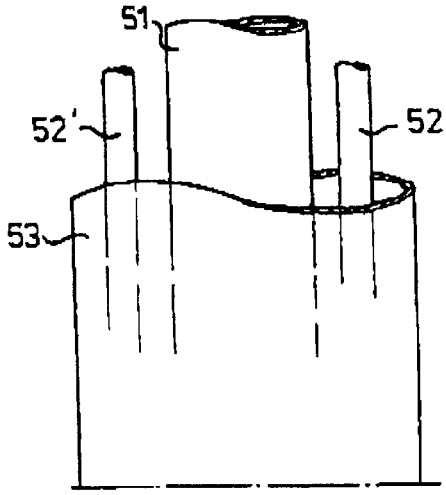
Figure 5A:
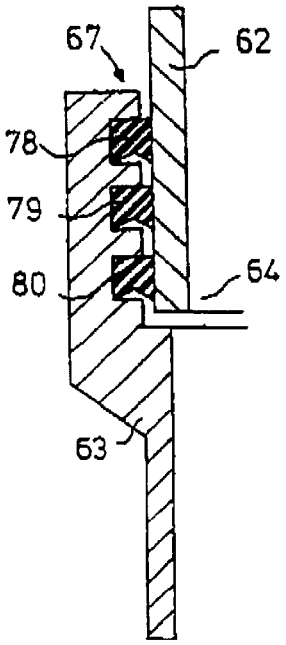
Figure 5B:
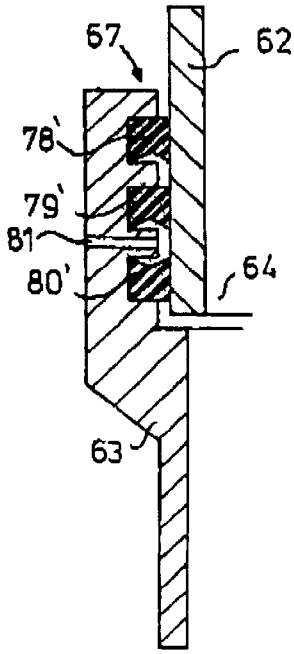
Figure 4:
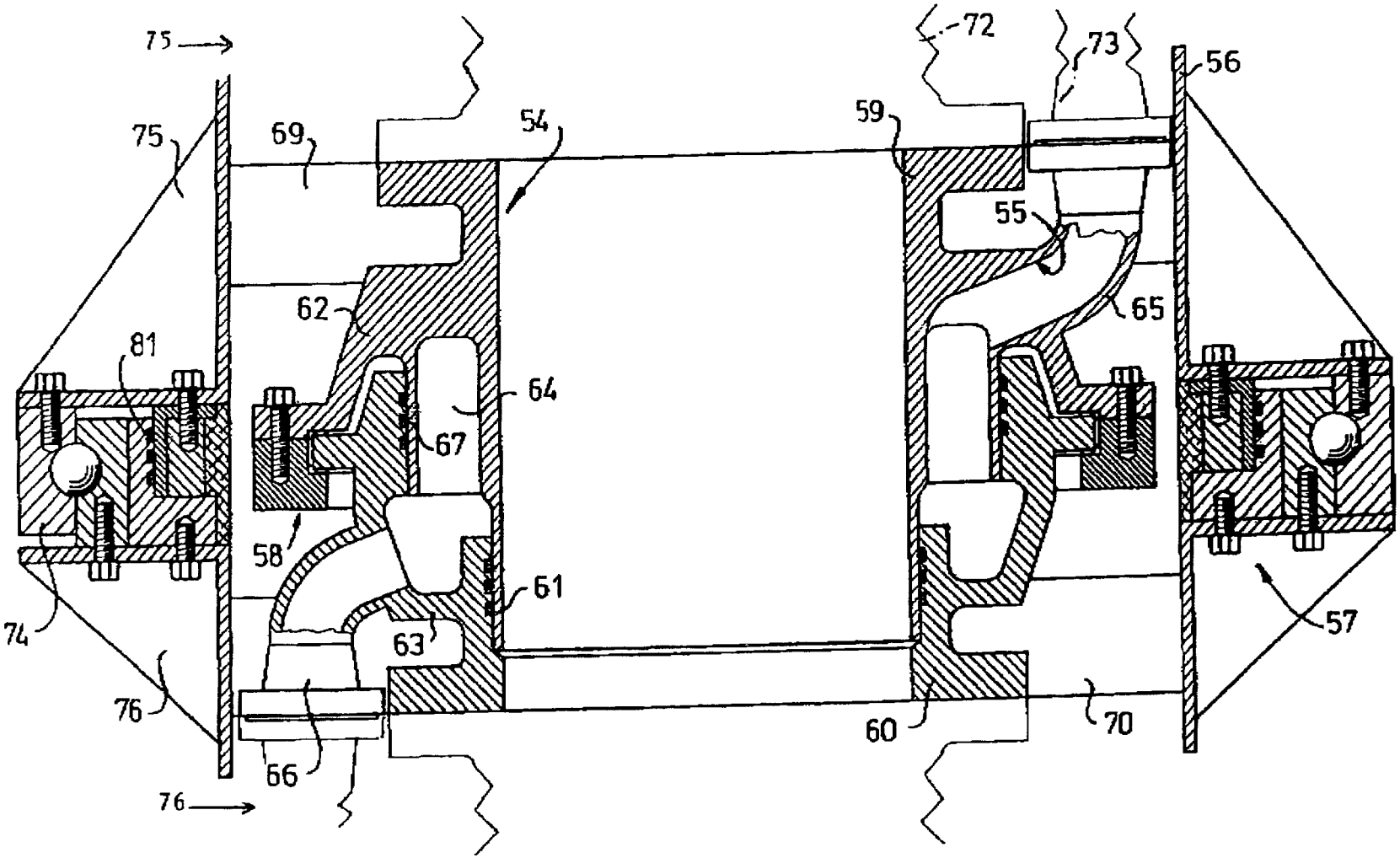
Figure 6:
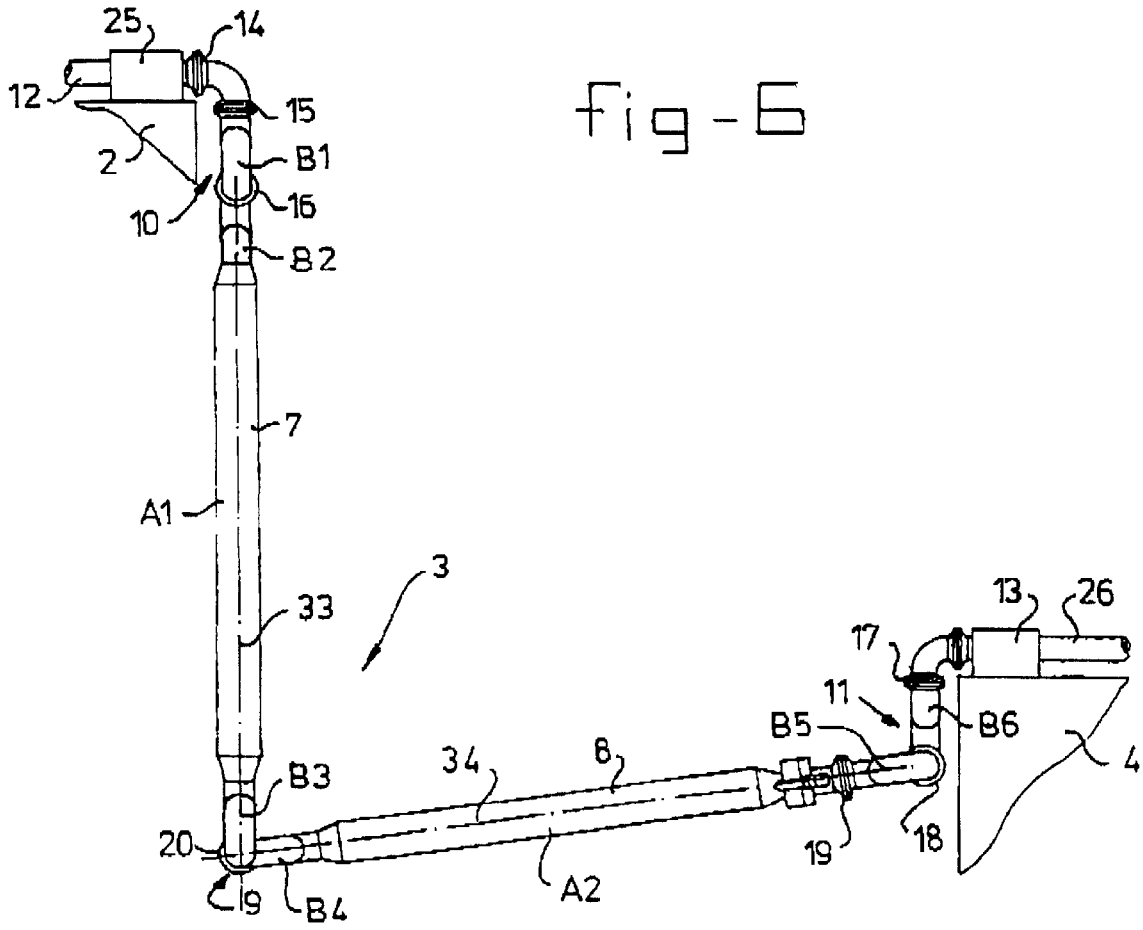
Figure 7:
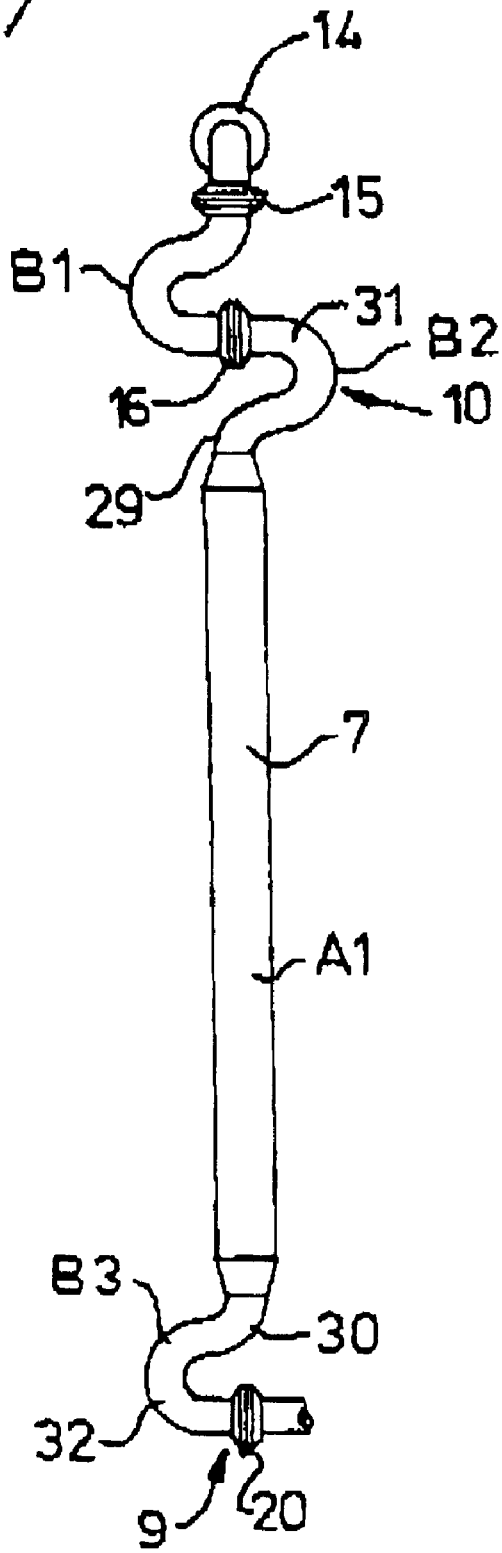
Figure 8:
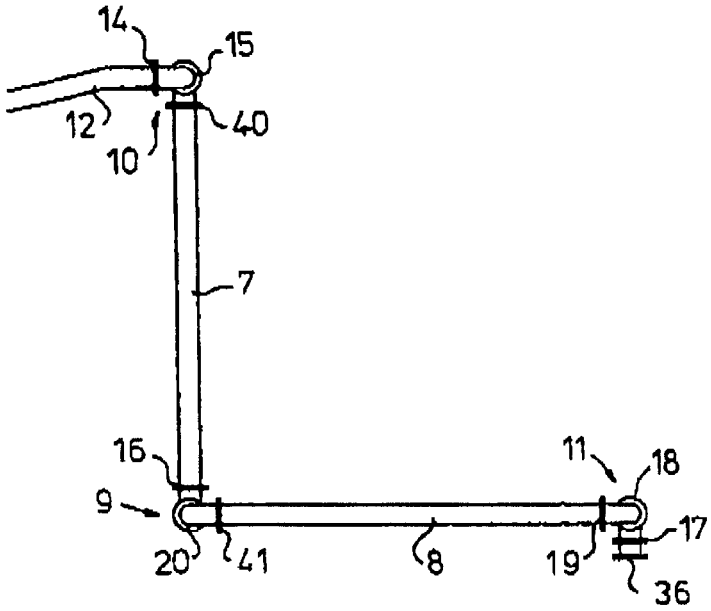
Figure 9:
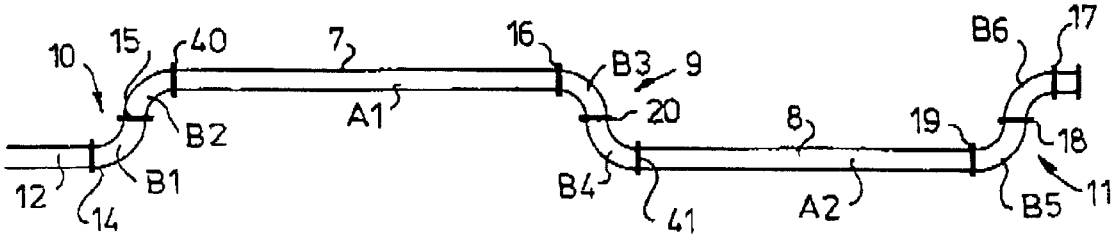

Some embodiments of a loading structure according to the present invention will by way of example be described in more detail with reference to the accompanying drawings. In the drawings:

FIG. 1 shows a schematic side view of a loading structure according to the present invention, FIG. 2 shows a side view of a preferred embodiment of the fluid transfer boom of FIG. 1 on an enlarged scale, FIGS. 3*a* and 3*b* show a cross-sectional part of one of the arms of the transfer boom comprising alternative configurations of the LNG supply duct and the vapour return duct, FIG. 4 shows an enlarged cross-sectional part of the arms of the transfer boom near a swivel joint comprising a parallel LNG duct and vapour return duct connected to a toroidal swivel, FIGS. 5*a* and 5*b* show sealing arrangements of the toroidal LNG vapour chamber located around the LNG duct, FIG. 6 shows a side view of a second embodiment of the fluid transfer boom according to the present invention on an enlarged scale, FIG. 7 shows a frontal view of the vertical arm of FIG. 6, FIG. 8 shows a side view of another embodiment of a fluid transfer boom, and FIG. 9 shows a plan view of the embodiment of FIG. 8 in an extended posistion.

FIG. 1 schematically shows the loading structure 1 according to the present invention comprising a storage structure 2 which is connected to a shuttle tanker 4 via a fluid transfer boom 3. The storage structure 2 may for instance comprise an offshore storage buoy for liquified natural gas which is anchored to the seabed by means of anchor lines. In the embodiment that is shown in FIG. 1, the storage structure 2 comprises a weathervaning vessel. The tanker 4 is moored to the vessel 2 via a hawser 6. The transfer boom 3 is formed by two arms 7, 8 which at their first ends 9 are connected via a first swivel joint. The vertical arm 7 is at its second end 10 suspended from a support arm 35 on the stem of vessel 2 and is connected to a substantially horizontally extending pipe section 12. The second arm 8 is at its second end 11 connected to a connecting element 13 on the tanker 4, for instance of the type as described in Offshore Technology Conference 3844, page 439–page 449, published in 1980. The connecting element 13 may comprise a hydraulic clamping arrangement acting on a flange 36 of the second end 11 of the arm 8 and on a fixed flange of the connecting part that is attached to the tanker 4.

A forward part 37 of the support arm 35 is via a cable 38 connected to the second and 11 of the arm 8 for positioning the arm properly with respect to the connector 13 on the vessel 4. At the first end 9 of the arms 7,8, a counterweight 39 is provided such that after disconnecting the second end 11 from the connector 13, the arm 8 will swing in the direction of the arrow A towards the vertical arm 7. A further cable 40 is connected to the first end 9 to pull both arms 7 and 8 into a nonactive parking position towards the support arm 35. In the retracted position, the transfer boom 3 is out of the way of vessels approaching the storage structure 2.

An alternative for docking the arm 8 against the vertical arm 7 comprises the use of cable 42, which in FIG. 1 has been indicated with a dashed line. The cable 42 is on one side connected to the second end 11 of the arm 8 and runs along a sheave mounted on the support arm 35 near the top of the arm 7. This arrangement can be used without a counter weight 39.

A cradle 43 may be provided on the vertical arm 7 for receiving the arm 8 and attaching it in a stationary manner to the arm 7. An additional cradle 43' is provided on the support arm 35 for engaging the arm 7 when it is pulled into its parking position via the cable 40. The craddles 43, 43' arrest the movements of the arms 7, 8 which would otherwise lead to a continuous wear of the swivel seals and the bearings of the swivel joints of the outer arms 7,8.

As can be seen from FIG. 2, the first arm 7 comprises three swivel joints 14, 15, and 16. At the first end 9, both arms 7 and 8 are connected via a swivel joint 20. At the second end 11 of the second arm 8, three swivel joints 17, 18, and 19 are provided.

Each swivel joint 14, 15, 16, 17, 18, 19 or 20 can rotate around an axis parallel to the centre line of the piping that is connected to said swivel joints. By means of the swivel joints 14, 20, and 18 the centre lines 33, 34 of the arms 7 and 8 can be rotated towards and away from each other in the plane of the drawing. By rotation around the swivel joints 15 and 19 the arms 7 and 8 can swing into and out of the plane of the drawing and rotate around the center line 34, respectively, for allowing roll of the vessel 2 and the anker 4. Rotation around the swivel joints 16 and 17 allows the tanker 4 to yaw with respect to the vessel 2.

At the second end 10, the first arm 7 is constructed of a first pipe section B1 which is formed by a 180°, 45° and a 90° bend. This bend section B1 is at its upper end connected to the piping section 12 via the swivel joint 14 and is at its lower end connected to a pipe section B2 via the swivel joint 15. The pipe section B2 comprises a 180° and a 90° bend. The pipe section B2 is connected to a straight pipe section A1 via a fixed flange 40. The straight pipe section A1 of the first arm 7 is connected to a 180° and 90° bend pipe section 33 via the swivel joint 16.

The second arm 8 comprises at the first end 9 a 180°, 45° and 90° bend pipe section B4 which is connected to the pipe section B3 of the first arm 7 via the swivel 20. The pipe section B4 is connected to a straight part A2 via a fixed flange 41. At its second end 11, the second arm comprises a 180° and 90° bend pipe section B5 connected to the swivel joints 18 and 19. Connected to the swivel joint 18 is bend pipe section B6 comprising a 180° and 90° bend ending in a swivel joint 17 and a short connecting pipe 21 leading to the connecting flange 36. The pipe 21 comprises a valve for shutting off the flow of LNG from the boom 3 to the tanker 4.

In the preferred embodiment all swivel joints 14, 15, 16, 17, 18, 19, and 20 are identical, The same applies for arms section Al and A2. Bend pipe sections B2, B3, B5 and B6 are similar, as are the fixed flange connections 40 and 41, FIG. 3*a* shows a partial cross-section through one of the arms 7 or 8, wherein a central LNG duct 51 is comprised within each arm, A concentric vapour return duct 52 is located around the inner duct 51 Both ducts 51 and 52 are confined within the wall 53 of the arms 7 or 8. It is also possible to use in the embodiment of FIG. 3*a* the central duct 51 as a vapour return duct, while using the concentric outer duct 52 as the LNG supply duct.

As shown in FIG. 3*b*, multiple vapour return ducts 52,52' may be used within the outer wall 53 of the arms 7,8 at a distance from the central LNG duct, As the temperature of the central duct 51, which may be about −160° C., is colder than the temperature of the vapour return ducts, which may be about −120° C., this arrangement is preferred as it allows for proper thermal insulation. In the LNG duct, pressures are generally between 10–20 bar whilst in the vapour return ducts pressures are generally between 2–5 bar.

FIG. 4 shows an embodiment wherein an LNG supply duct 54 and a vapour return duct 55 are located side by side within the wall 56 of the support arms 75,76. Near the swivel joint 57 between the upper and lower support arms 75,76, the LNG supply duct 54 and the vapour return duct 55 are each provided with an internal swivel joint 58. The upper section 59 of the LNG supply duct 54 is rotatingly connected to the lower section 60 of that duct. A number of seals 61 bridge the space between the walls of the upper section 59 and lower section 60. An upper and lower annular wall part 62, 63 are connected to the upper section 59 and the lower section 60 of the LNG duct 54 respectively. Hereby a toroidal LNG vapour chamber 64 is formed. An outlet part 65 of the vapour return duct 55 is connected to the upper annular wall part 62, an inlet part 66 being connected to the lower annular wall part 63. Sealing elements 67 prevent the vapour from passing the interface between each rotating annular wall part 62, 63.

The upper section 59 and the lower section 60 of the LNG supply duct 54 and the upper and lower sections of the vapour return duct are connected to upper and lower support arms 75,76 via respective connecting elements 69, 70. Hereby the internal ducts 54, 55 follow the rotational motions of the outer support arm wall 56, As the upper and lower annular walls 62, 63 are fixedly connected to the upper section 59 and lower section 60 of the LNG supply duct 54 respectively, these walls also follow the rotational movements of the upper and lower outer support arms 75,76. By means of the present construction the vapour return duct 55 may be spaced away from the colder LNG supply duct 54. Insulating material may be provided around the LNG supply duct 54 to be thermally insulated from the vapour return duct 55 and the wall 56 of the outer support arms 75,76. To allow for thermally induced contraction and expansion of the LNG supply duct 54 and the vapour return duct 55 and to prevent too large thermal stresses from acting on the internal swivel joint 58, both ducts 54, 55 are near the swivel joint 58 provided with metal bellows 72, 73. The bellows 72, 73 prevent the thermal loads on the piping from acting on the swivel joint 58 thus maintaining the internal swivel joint 58 aligned with the swivel joint 57 of the outer support arms 75,76.

The swivel joint 57 of the outer support arms 75,76 comprises an axial radial bearing 74 connecting the outer arms 75,76. A seal 81 provides a gas tight enclosure of the outer arms 75,76 around the inner ducts 54, 55.

Although in the embodiment of FIG. 4 the axial positions of the swivel joint 57 of the outer supporting arms 75,76 and the swivel joint 58 of the inner ducts are shown to be similar, the swivel joints 57 and 58 can also be placed at spaced apart axial positions.

FIG. 5*a* shows an enlarged detail of the of the sealing arrangement 67 of FIG. 4, wherein three piston seals 78,79, 80 are placed in the seal extrusion gap between the upper wall part 62 and the lower wall part 63 of the toroidal LNG vapour chamber 64. In FIG. 5 the pressure in the toroidal chamber 64, on the right hand side of the seals, is about 5 bar, and is higher than the pressure exerted by the non-pressurised gas (at 1 bar) within the wall 56 of the upper and lower arms 75,76 (acting on the left hand side of the seals in FIG. 5).

In an alternative seal arrangement as shown in FIG. 5*b*, two adjacent seals such as seals 79' and 80' may be orientated in opposing directions and may be pressurised via a channel 81 ending between the seals and being in fluid communication with a higher pressure source, such as with a non-methane containing gas, for instance a pressurised inert gas. The sealing arrangements shown in FIGS. 5*a* and 5*b* can also be used for the seals 61 of the LNG ducts.

FIGS. 6 and 7 shows a detail of an alternative embodiment of the boom construction, similar to the construction as is shown in FIG. 2. In FIGS. 6 and 7 similar components have been given the same reference numerals as used in FIG. 2. It can be seen that the first arm 7 comprises three swivel joints 14, 15 and 16 at its second end 10. The second arm 9 comprises three swivel joints 17, 18 and 19 at its second end 11. At the first ends 9 of both arms 7 and 8 a single swivel joint 20 is provided.

The first and second arm 7 and 8 each comprise a singular straight section A1 and A2. The first arm 7 comprises at its second end 10 two 180°, 90° bend sections B1, B2. The first ends 9 of both arms 7 and 8 each comprise a 90°, 180° bend B3, B4. At its second end 11 the second arm 8 comprises two 180°, 90° bends B5, B6. All bend pipe sections B1–B6 are identical, as are the swivel joints 14, 15, 16, 17, 18, 19, and 20.

The length of each arm 7, 8 may for instance amount up to 20 meters. The outer diameter of each arm 7, 8 may amount to about 2 meters.

Finally, FIGS. 8 and 9 show a side view and a plan view of a transfer boom wherein the bend pipe sections B1–B6 are all formed by a 90° bend. Again, similar components have been given the same reference numerals as are used in FIGS. 2 and 6. The first arm 7 comprises two swivel joints 14,15 at its second end 10, the second arm 8 comprising three swivel points 17,18 and 19 at its second end 11. The first end 9 of the arms 7,8 comprises two swivel joints 16,20.

Although the embodiments described in FIGS. 2, 5 and 6 show three swivel joints that are located at one or both of he second ends 10, 11 of the first or second arm 7, 8, other locations of the swivel joints are comprised within the scope of the present invention, such a construction wherein each second end 10, 11 comprises two swivel joints. three swivel joints being provided at the first ends 9.

What is claimed is:

1. Loading structure (1) for liquefied natural gas, comprising a fluid transfer boom (3) for transfer of cryogenic liquids between a first storage structure (2) and a vessel (4), the boom (3) having an elongated substantially vertical first arm (7, 75) and an elongated substantially horizontal second arm (8, 76) which are mutually connected at a first end (9) via a swivel joint (20, 57), the first and second arms (7, 8; 75, 76) having substantially rigid walls and having each a second end (10, 11) connected to the storage structure (2) and connectable to the vessel (4) respectively, a liquefied natural gas tubular conduit (54) supported within the first and second arms (7, 8) which form a gas tight housing around the liquefied natural gas conduit, the liquefied natural gas tubular conduit (54) having deformable wall sections (72) at least adjacent the internal swivel joint (58) for allowing thermally induced expansion and/or contraction in a length direction of the tubular conduit.

2. Loading structure (11) according to claim 1, wherein outer walls (53, 56) of the arms (7, 8) define a continuous fluid path between the second ends (10, 11) of the arms (7, 8).

3. Loading structure (1) according to claim 1, wherein a vapor return duct (55) is supported within the arms (7, 8; 75, 76), parallel to the liquefied natural gas duct (54), the internal swivel joint (58) comprising a toroidal chamber (64) around the liquefied natural gas duct (54) having an inlet connected to an upstream vapor return duct section (66) and an outlet connected to a downstream vapor return duct section (65).

4. Loading structure (1) according to claim 3, wherein the vapor return duct (55) is near the internal swivel joint (58) provided with deformable wall parts (73).

5. Loading structure (1) according to claim 1 wherein the space inside the arms (7, 8; 75, 76) and at least one of outside of the liquefied natural gas duct (54) and the vapor return duct (55) is filled with a gas that is pressurized at a pressure above the pressure in the liquefied natural gas duct (54) or in the vapor return duct (55).

6. Loading structure (1) according to claim 5, wherein the gas is a non-flammable inert gas.

7. Loading structure (1) according to claim 3, wherein at least one of the liquefied natural gas duct (54) and the vapor return duct (55) comprises a seal arrangement (61, 67) comprising two sealing elements (79', 80') located in opposing directions and a channel (81) extending from between the sealing elements (79', 80') to be in fluid communication with a non-methane pressure fluid source.

8. Loading structure (1) according to claim 1, wherein the first and second arms (7, 8) are via the first swivel joint (20) rotatable around an axis perpendicular to the plane defined by the center lines (33, 34) of the arms, the first and second arms (7, 8) being with a second end (10, 11) connected to the storage structure (2) and connectable to the vessel (4) respectively, via at least two swivel joints each, to be able to rotate around an axis in the plane of the center lines (33, 34) and around an axis perpendicular to the center lines, the arms (7, 8) comprising at least seven swivel joints (14, 15, 16, 17, 18, 19, 20) in total each arm being rotatable around three perpendicular axes, the first arm (7) being suspended from the storage structure (2) in a generally vertical direction, wherein the second arm (8) can extend between the first end (9) of the first arm (7) and the vessel (4) in a generally horizontal direction.

* * * * *